US008449317B1

(12) United States Patent
Dang

(10) Patent No.: US 8,449,317 B1
(45) Date of Patent: May 28, 2013

(54) SEALED CONNECTOR ASSEMBLY AND METHOD OF MAKING

(75) Inventor: Phong Dang, Kent, WA (US)

(73) Assignee: Carlisle Interconnect Technologies, Inc., Kent, WA (US)

( * ) Notice: Subject to any disclaimer, the term of this patent is extended or adjusted under 35 U.S.C. 154(b) by 331 days.

(21) Appl. No.: 12/972,211

(22) Filed: Dec. 17, 2010

Related U.S. Application Data

(60) Provisional application No. 61/288,181, filed on Dec. 18, 2009.

(51) Int. Cl.
*H01R 13/58* (2006.01)

(52) U.S. Cl.
USPC ..... 439/449

(58) Field of Classification Search
USPC ..... 439/449, 161, 271–275, 559, 523, 439/584, 910, 932, 927
See application file for complete search history.

(56) References Cited

U.S. PATENT DOCUMENTS 4,707,047 A 11/1987 Michaels et al.
5,547,395 A * 8/1996 Delamotte ..... 439/578
5,775,830 A 7/1998 Courtaigne
6,357,764 B1 3/2002 Gaines et al.
7,113,679 B2 9/2006 Melton et al.
7,278,869 B1 10/2007 Bernhart et al.
7,530,847 B2 * 5/2009 Siems ..... 439/607.41
2002/0013103 A1 * 1/2002 Kamei et al. ..... 439/730

OTHER PUBLICATIONS

Tyco Electronics, Atum, Specification Sheet, publicly available as of Dec. 2009, 2 pages.

* cited by examiner

*Primary Examiner* — Edwin A. Leon
(74) *Attorney, Agent, or Firm* — Stoel Rives LLP

(57) ABSTRACT

A connector such as an electrical connector for a data cable assembly, preferably includes a frontshell mechanically fastened to a backshell with a gasket secured between. Mechanical fasteners apply force to the gasket and deform the gasket which forms a moisture ingress resistant seal between the frontshell and the backshell. A second moisture ingress resistant seal is formed over a strain relief that includes external grooves. An adhesive-lined heat-shrink tube mechanically grips the strain relief when heat is applied and the heat-shrink tube shrinks. The adhesive-lined heat-shrink tube also forms O-ring like seals in the grooves when heat is applied and the adhesive melts then re-solidifies in the grooves.

22 Claims, 11 Drawing Sheets

SEALED CONNECTOR ASSEMBLY AND METHOD OF MAKING

RELATED APPLICATION

This application claims priority under 35 U.S.C. §119(e) to U.S. Patent Application No. 61/288,181, filed Dec. 18, 2009, for Sealed Connector Assembly And Method Of Making, which is fully incorporated by reference herein.

TECHNICAL FIELD

The following specification and claims relate to connectors and to connectors with moisture ingress resistant seals.

BACKGROUND

Electrical connectors are commonly used to terminate the end of an electrical conductor, such as a wire, for connecting the conductor to electronics or electric equipment. Moisture in electrical connectors may cause electrical shorts or degrade the connector materials through oxidization, establishing a galvanic cell, or other mechanism which degrades the quality of electrical connections within the electrical connector. Fires or other hazardous conditions may result, or the electrical connector may fail to properly conduct electricity or electric signals. Thus it is important to limit or prevent moisture ingress into electrical connectors in many applications.

Moisture may ingress into an electrical connector when the electrical connector is subjected to repeated air density changes. Air density changes occur when one or all of air temperature, relative humidity, and air pressure changes. Air temperature and relative humidity are meteorological phenomena, but can also be influenced by varying altitude above sea level. An increase in either temperature or humidity decreases the air density, and vice versa. Air pressure is also a meteorological phenomena, but is also heavily influenced by varying altitude above sea level. An increase in air pressure increases the air density, and vice versa.

When air is separated, for example a sealed chamber full of air with a first density placed in an atmosphere of air with a second density that is higher than the first density, air will move from the more dense region to the less dense region if given an opportunity such as a leaky seal. If dense air is able to move into an area containing less dense air, the dense air will bring any water vapor suspended in the dense air with it. Air density changes commonly occur in aircraft, and thus in electrical connectors mounted in aircraft. For example, an aircraft that descends from an altitude of 25,000 feet to sea level will contain electrical connectors filled with a lower density air than the surrounding atmosphere at sea level.

Common, current electrical connectors used in aircraft, such as part number 1877819-2 manufactured by Tyco Electronics Corporation of Menlo Park, Calif., United States, use a frontshell with a backshell adhered to the frontshell to form a moisture resistant seal. Such a backshell is commonly made from a rubber or other flexible heat-shrink material and is placed over a portion of the frontshell. Heat is applied to shrink the backshell and adhere the backshell to the frontshell. The present inventor has recognized that such heat-shrink backshells have several disadvantages such as requiring a high heat that may damage wires, solder joints, or other electrical conductors or components within the electrical connector. Additionally, heat-shrink backshells may release harmful fumes from the rubber or other flexible backshell material when heated; require a time consuming process to assemble; form a weak seal because of the complex shape of the heat-shrink backshell; or become brittle over time and break down, thus resulting in an ineffective moisture barrier by weakening or destroying any seal between the backshell and the frontshell.

The present inventor has recognized a need for a durable moisture ingress resistant connector suitable for use in environments where air density changes relatively frequently and rapidly, such as in aircraft traveling between sea level and 20,000 to 60,000 feet above sea level. The present inventor has also recognized a need for a durable moisture ingress resistant connector that is quickly assembled, forms a robust seal between a backshell and a frontshell, and is relatively easy to repair or replace. Some or all of the following embodiments may satisfy some or all of the above-described needs, or may satisfy other needs.

SUMMARY

Connectors may be used in multiple applications with different types of conductors such as fiber optics or wires. Connectors used with various types of conductors are within the scope of the following disclosure, although the following description of preferred embodiments focuses on electrical connector embodiments.

In a preferred arrangement, a moisture ingress resistant electrical connector is formed using a frontshell fastened to a backshell with a gasket in between. The frontshell has a closed connection side, that is, where the electrical connector plugs into another electrical connector, and a side with an opening to permit electrical conductors to pass through the frontshell. A backshell is mechanically fastened to the frontshell with a gasket between the backshell and the frontshell. The mechanical fastener compresses the gasket against an interior portion of the backshell, such as a sealing face or surface, or a gasket seat, to form a moisture ingress resistant seal. Preferably, the backshell includes an integral strain relief for one or more electrical conductors exiting the backshell. The strain relief preferably includes a tubular portion having a plurality of grooves on its exterior. An adhesive-lined heat-shrink tube is preferably shrunk over the electrical conductor and the strain relief to form a second moisture ingress resistant seal in cooperation with the grooves. Both moisture ingress resistant seals preferably inhibit moisture laden air from passing into the interior of the electrical connector as the electrical connector is subjected to repeated air density changes. For example, connectors with the seals described herein may preferably satisfy the requirements of Electronic Industries Alliance's EIA-364-03B-1999 (R2006) Altitude Immersion Test Procedure For Electrical Connectors.

Additional aspects and advantages will be apparent from the following detailed description of preferred embodiments, which proceeds with reference to the accompanying drawings.

DETAILED DESCRIPTION OF PREFERRED EMBODIMENTS

Figure 1:
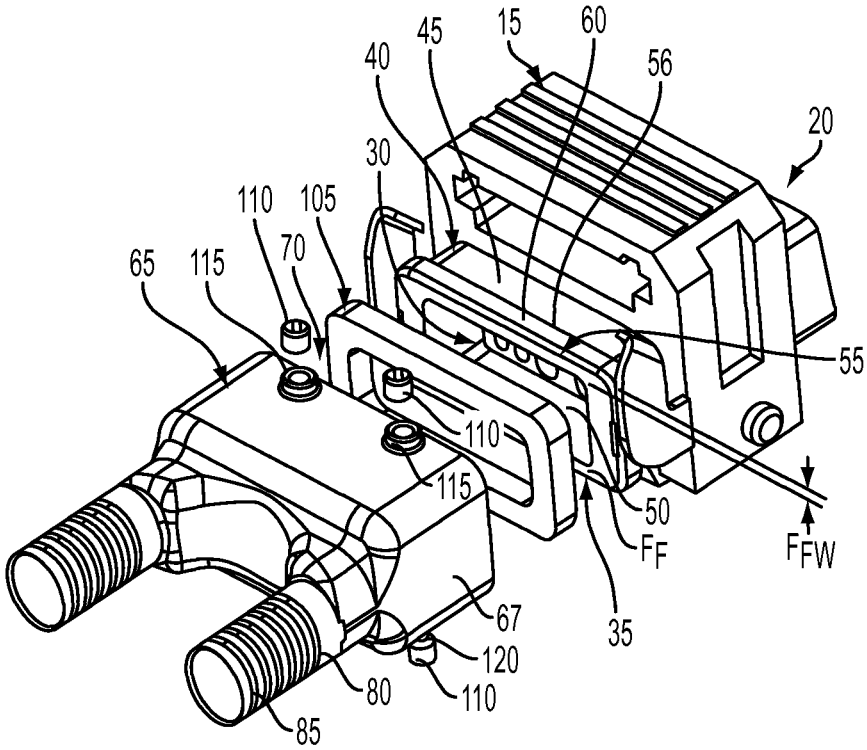
FIG. 1 is a top perspective partly exploded view of an electrical connector.

FIG. 1 illustrates an assembly view of a preferred embodiment. A frontshell 15 is mechanically fastened to a backshell 65 with a gasket 105 in between. Mechanical fasteners, such as set screws 110 and threaded bosses 115, apply pressure to gasket 105 to deform gasket 105 which forms a moisture ingress resistant seal between frontshell 15 and backshell 65. A second moisture ingress resistant seal is formed over strain reliefs 80 by an adhesive-lined heat-shrink tube 95 that forms O-ring like seals in grooves 85 when the adhesive melts and re-solidifies.

Figure 2:
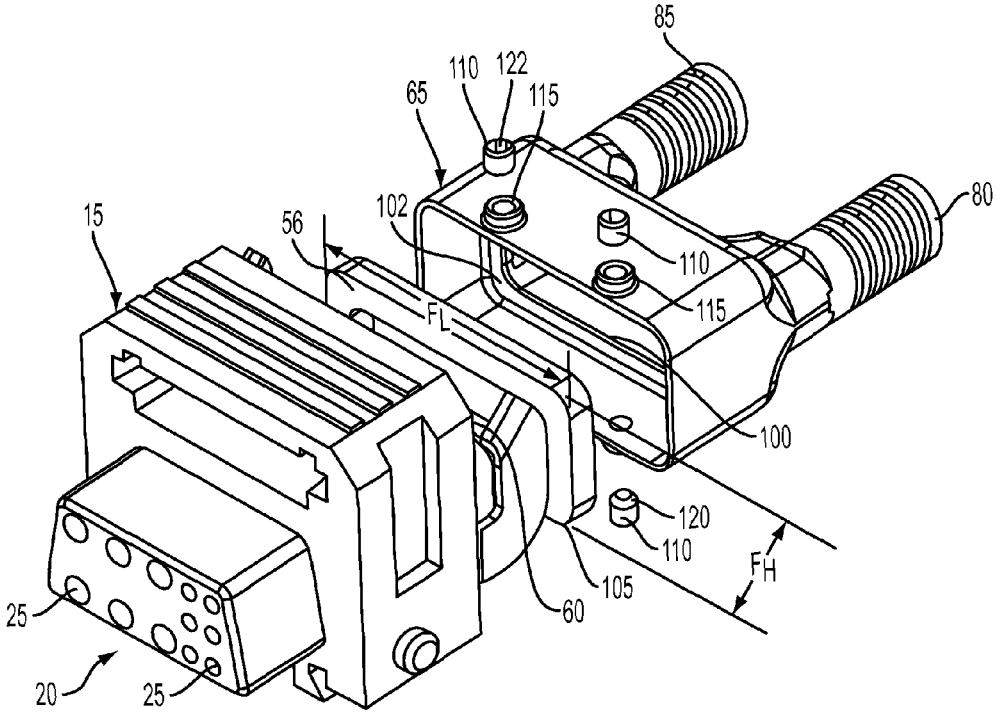
FIG. 2 is a front perspective partly exploded view of the frontshell of FIG. 1.

The frontshell 15 is preferably made from a rigid, relatively gas-impermeable material such as a glass fiber impregnated thermoplastic. Frontshell 15 includes a closed front side 20 that contains electrical contacts 25 (FIG. 2). Electrical contacts 25 may be male or female. Electrical contacts 25 are preferably sealed to closed front side 20 to prevent moisture ingress as is well known in the art.

Frontshell 15 also includes a hollow interior 30 and an open side 35. A protrusion 40 extends from open side 35 and includes a contiguous surface 45 that defines a loop. The loop defined by contiguous surface 45 preferably also frames the opening 50 in open side 35. A flange 55 extends from contiguous surface 45 in a direction that is substantially orthogonal to contiguous surface 45. Flange 55 is located away from frontshell 15 and includes a perimeter surface 60.

A backshell 65 is preferably made from a rigid gas-impermeable or relatively gas-impermeable material, such as T6-7075 aluminum, aluminum alloys, stainless steel, titanium and titanium alloys, high density thermoplastics such as acrylonitrile butadiene styrene and nylon, or other suitable material. Metals are preferred because they tend not to offgass under reduced pressure conditions. Backshell 65 is preferably made by machining a solid block of material to the desired shape, but may be made by other suitable manufacturing techniques, for example, casting.

Backshell 65 includes a backshell body 67 with an opening 70. Opening 70 includes an interior contoured surface 75 (FIG. 4) that preferably matches, or is substantially the same as, the contour of perimeter surface 60. For example, the height $O_H$ of opening 70 may be 0.005 units, such as inches, more than the height $F_H$ of flange 55 with a tolerance of plus or minus 0.003 units, such as inches. And, the length $O_L$ of opening 70 may be 0.005 units, such as inches, more than the length $F_L$ of flange 55 with a tolerance of plus or minus 0.003 units, such as inches.

Figure 3:
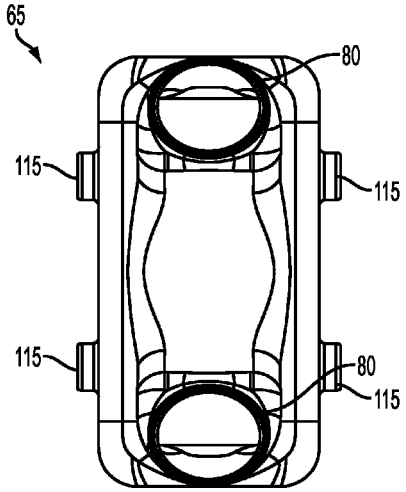
FIG. 3 is a rear plan view of the backshell of FIG. 1.
Figure 5:
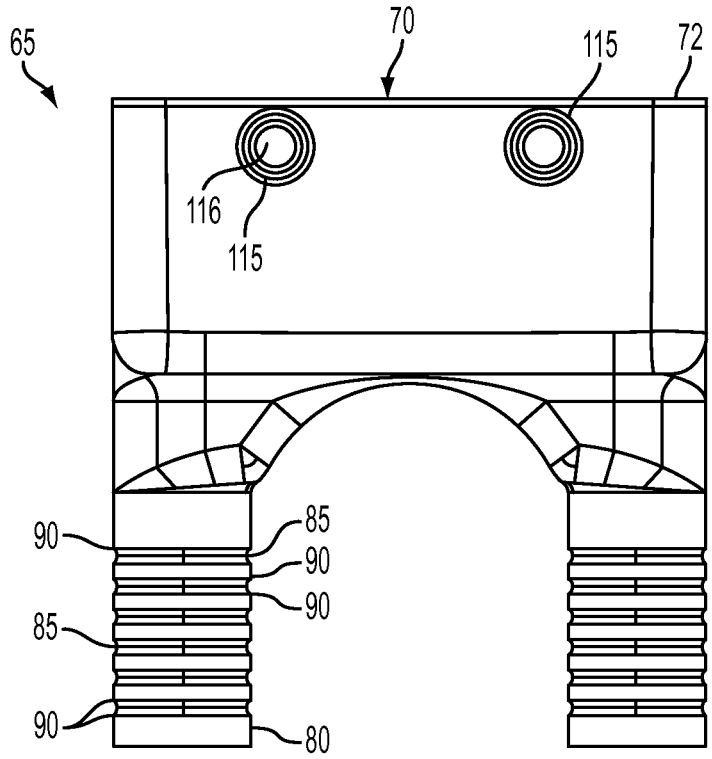
FIG. 5 is a top plan view of the backshell of FIG. 1.
Figure 6:
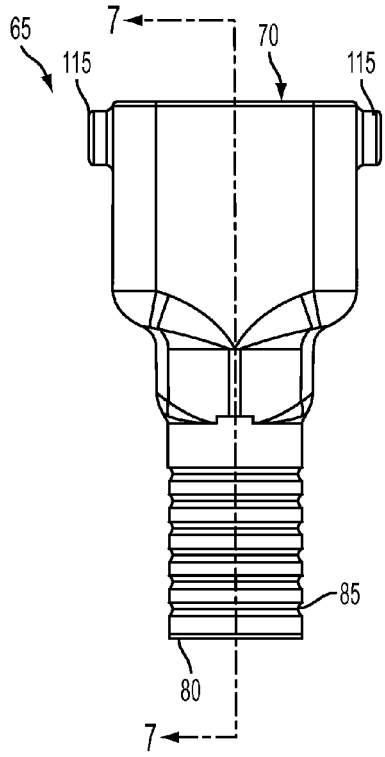
FIG. 6 is a side plan view of the backshell of FIG. 1.
Figure 7:
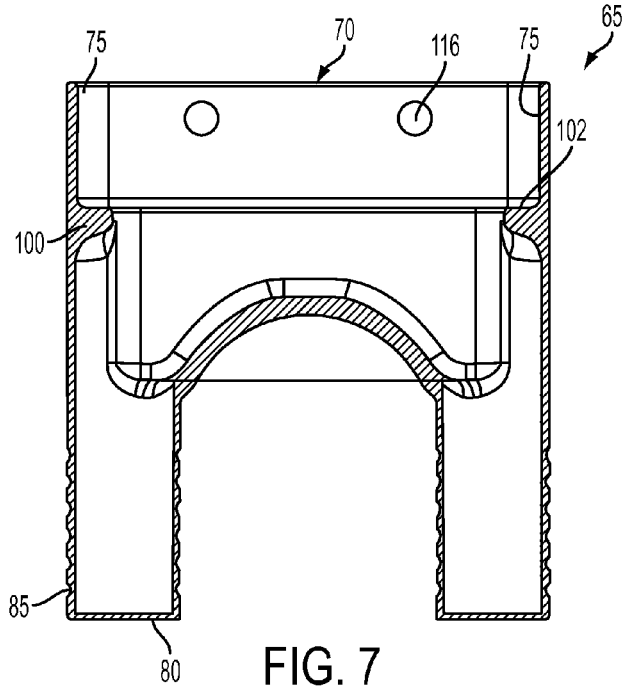
FIG. 7 is a top sectional view of the backshell of FIG. 6 taken along the line 7-7.
Figure 8:
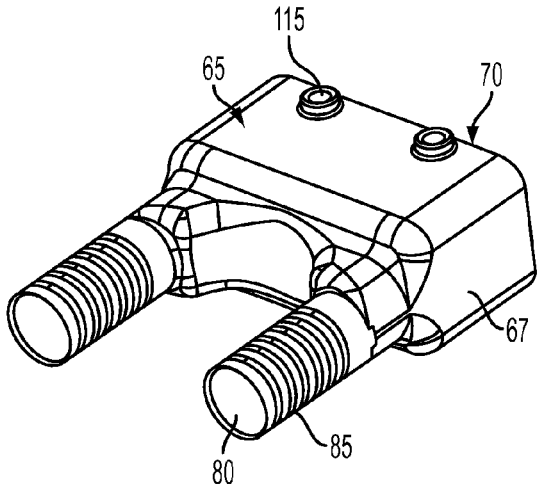
FIG. 8 is a top rear perspective view of the backshell of FIG. 1.
Figure 9:
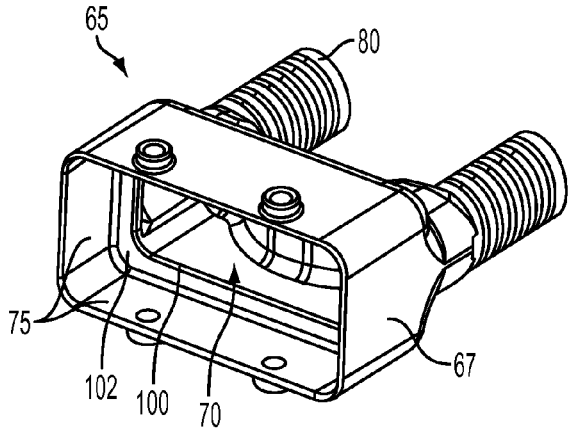
FIG. 9 is a top front perspective view of the backshell of FIG. 1.

Backshell 65 includes integral strain reliefs 80. Strain reliefs 80 are preferably tubular, and preferably have an oval cross section (FIG. 3). One or more grooves 85 are formed on an exterior surface of strain reliefs 80. Grooves 85 are preferably circumferential, that is, each groove 85 preferably defines a continuous loop around the strain relief 80. Each groove 85 preferably includes a radius 90, which in one embodiment may help prevent sharp corners that could degrade the seal formed by adhesive-lined heat-shrink tube 95 (FIG. 15), or may help a flowable adhesive fill or substantially fill grooves 85. Securing an adhesive-lined heat-shrink tube 95 over strain reliefs 80 and filling or substantially filling grooves 85 with a flowable adhesive is discussed in more detail below with reference to FIGS. 5 and 13.

Figure 4:
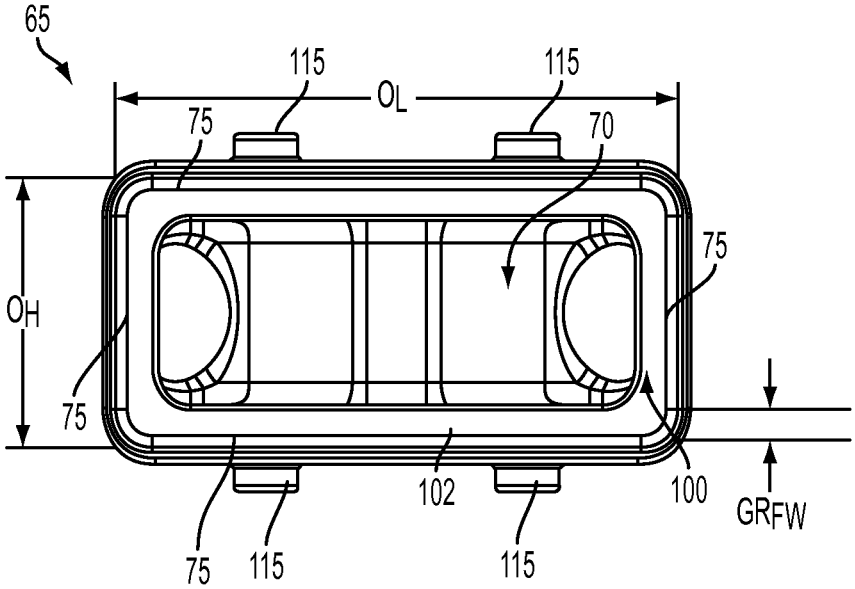
FIG. 4 is a front plan view of the backshell of FIG. 1.

Backshell 65 also includes a gasket rest 100 within opening 70 (FIG. 4). For example, gasket rest 100 may include a step, ledge, platform, inset, or other suitable structure. Gasket rest 100 is preferably attached to, or formed as part of, the interior of opening 70 and follows the interior contour of opening 70. Gasket rest 100 is preferably located a distance inward, that is, away from opening 70 and toward strain reliefs 80, from the edge 72 of opening 70 in the range of approximately 250% to approximately 300%, and preferably approximately 272%, of the thickness of gasket 105.

Figure 10:
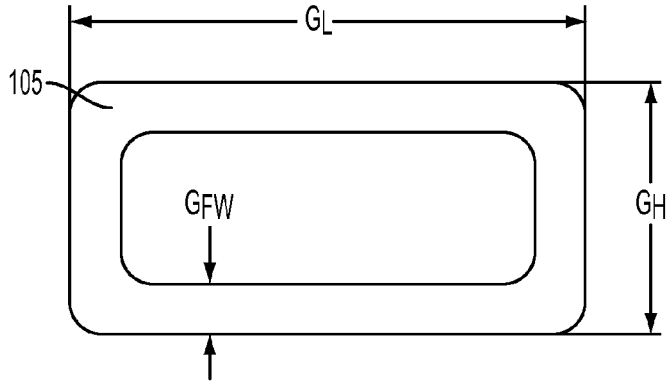
FIG. 10 is a front plan view of the gasket of FIG. 1.
Figure 11:
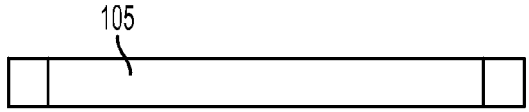
FIG. 11 is a top plan view of the gasket of FIG. 1.
Figure 12:
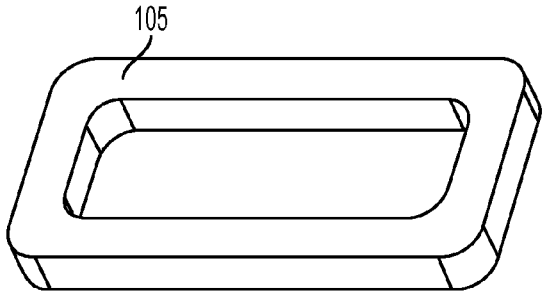
FIG. 12 is a front perspective view of the gasket of FIG. 1.

Gasket rest 100 includes a support face 102 with a face width $GR_{FW}$ (FIG. 4) that is preferably in the range of approximately 100% to approximately 70%, and preferably approximately 80%, of the face width $G_{FW}$ (FIG. 10) of gasket 105. In a preferred embodiment, the overlap between gasket rest 100 face width $GR_{FW}$ and gasket 105 face width $G_{FW}$ is at least 0.010 of an inch. Providing a gasket rest 100 with a face width $GR_{FW}$ that is in the range of approximately 100% to approximately 70% of the face width $G_{FW}$ of gasket 105 may help prevent misalignment between gasket 105 and gasket rest 100 that could result in a leaky seal when gasket 105 is compressed between gasket rest 100 and flange 55.

Figure 14:
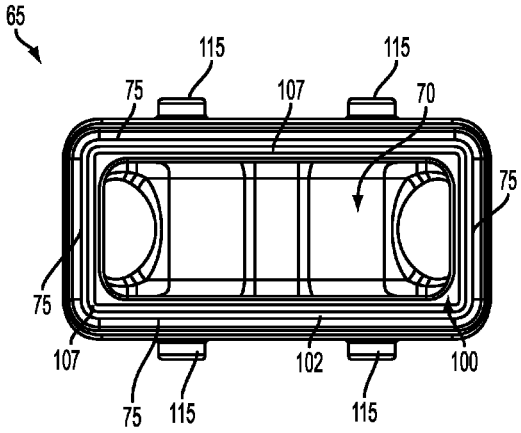
FIG. 14 is a front plan view of an alternate backshell.

With reference to FIG. 14, support face 102 of gasket rest 100 may include seating groove 107. Preferably, a portion of the material composing face width $G_{FW}$ of gasket 105 is displaced into seating groove 107 when gasket 105 is compressed between gasket rest 100 and flange 55. Seating groove 107, if included, is preferably machined as a track having a radius. In other words, it is preferred for seating groove 107 to not have sharp corners which may inhibit the material composing gasket 105 from displacing into seating groove 107. Seating groove 107 is preferably approximately 0.040 of an inch to approximately 0.050 of an inch deep at its deepest point from the surface of the support face 102 of gasket rest 100. Alternatively, one or more seating grooves 107 may be included on the support face 102 of gasket rest 100.

Gasket 105 is made from a pliable material and is preferably dimensioned to closely match opening 70. Gasket 105 is preferably made from fluorosilicone with a Durometer hardness in the range of about 40 Shore A to about 50 Shore A. Preferably, the gasket is made from a fluorosilicone that meets the requirements of U.S. military specification MIL-R-25988/1A (Jul. 10, 1975). Other suitable materials, such as natural rubber, may be used for gasket 105. Preferably, there is sufficient frictional engagement between gasket 105 and opening 70 to retain gasket 105 in place in opening 70, for example, during assembly of an electrical connector or during shipping of an assembled backshell 65 that is not connected to a frontshell 15.

In one embodiment, gasket 105 has a height $G_H$ (FIG. 10) that is approximately the same as the height $O_H$ of opening 70. For example $G_H$ and $O_H$ may have the same dimension where the specified tolerance is plus or minus 0.003 units, such as inches, for opening 70 and plus or minus 0.012 units, such as inches, for gasket 105. Preferably, the length $O_L$ of opening 70 is approximately 0.005 units, such as inches, longer than the length $G_L$ of gasket 105, where the specified tolerance is plus or minus 0.003 units, such as inches, for opening 70 and plus or minus 0.012 units, such as inches, for gasket 105. Other suitable dimensions and units may be used.

In one embodiment, the gasket 105 height and length $G_H$ and $G_L$ (FIG. 10) have the same dimensions as the flange 55 height and length $F_H$ and $F_L$ (FIG. 2) with a specified tolerance of plus or minus 0.003 units, such as inches, for flange 55 and plus or minus 0.012 units, such as inches, for gasket 105. Alternately, flange 55 may have a face width $F_{FW}$(FIG. 1) that is in the range of approximately 100% to approximately 70% of the face width $G_{FW}$ of gasket 105. Other suitable dimensions may be used. Preferably, flange 55 face width $F_{FW}$ operates as a gasket seat to provide a sealing surface for gasket 100 when gasket 100 is under compression. Flange 55 face $F_E$ may include one or more seating grooves, such as seating groove 107.

A mechanical fastener, such as set screws 110 and threaded bosses 115, holds backshell 65 to frontshell 15. Preferably the mechanical fastener includes a backshell engaging portion and a tapered, sloped, or wedge-shaped surface that engages a portion of flange 55 of frontshell 15 to draw backshell 65 and frontshell 15 towards each other.

In a preferred embodiment four set screws 110 thread through four bosses 115 to engage a back edge 56 of flange 55. Preferably, support face 102 is 0.200, or approximately 0.200, inch from the center 116 of threaded bosses 115. Preferably, the distance between support face 102 and the center of threaded bosses 115 locates conically tapered tips 120 (FIG. 2) of set screws 110 at the back edge 56 of flange 55. Back edge 56 faces away from backshell 65 and gasket 100 when backshell 65 and frontshell 15 are secured together. Set screws 110 preferably have conically tapered tips 120 that engage back edge 56 of flange 55 to progressively move backshell 65 and frontshell 15 towards each other as set screws 110 are driven deeper into threaded bosses 115. Tapered tips 120 are located distal from a tool engaging end 122 of each set screw 110. More or fewer set screws 110 and threaded bosses 115 may be used.

Other mechanical fasteners, such as a spring loaded latch (not illustrated) could be used to retain backshell 65 and frontshell 15 in a clamped relationship. For example, a spring loaded latch plate may provide a protrusion, such as a sloped surface, for engaging back edge 56 of flange 55. As the spring loaded latch plate is slid, or rotated, and locked into position, the protrusion may draw backshell 65 and frontshell 15 towards each other to establish a sealing barrier by applying pressure to gasket 105. When moving such a spring loaded latch plate to an unlocked position, the protrusion may retract with the assistance of a compressive spring residing between the spring loaded latch plate and a surface of backshell 65, such as the surface facing frontshell 15 or the top surface. Moving the spring loaded latch plate to an unlocked position preferably liberates backshell 65 from frontshell 15. Other suitable fasteners may be used to hold backshell 65 to frontshell 15.

In a preferred embodiment, set screws 110 are secured in place in threaded bosses 115. An adhesive, such as Locktite® 222MS Thread Lock, made by Henkel AG & Co. KGaA of Düsseldorf, Germany, may be applied to set screws 110 prior to being threaded in threaded bosses 115. In some embodiments there may be a thread mismatch between set screws 110 and threaded bosses 115, or other suitable securement may be used.

When assembling an electrical connector, gasket 105 is placed in opening 70 and rests against gasket rest 100. An electric conductor 125, such as a wire, cable, or other suitable conductor, is inserted through each strain relief 80 and electrically connected to electrical contacts 25. Alternatively, other conductors such as fiber optics may be used.

Flange 55 is inserted into opening 70 and gasket 105 is compressed to permit tapered tips 120 of set screws 110 to engage back edge 56 of flange 55. Set screws 110 are then driven deeper into threaded bosses 115, preferably incrementally and alternately as when tightening lug nuts of an automobile wheel, to compress gasket 105 to approximately 50% of its original thickness. In a preferred embodiment, set screws 110 move backshell 65 and frontshell 15 approximately 0.050 of an inch towards each other after flange 55 contacts gasket 105 while gasket 105 sits substantially flat on gasket rest 100. Preferably, when gasket 105 is compressed to approximately 50% of its original thickness gasket 105 displaces into seating groove 107 and a force of approximately 5 pounds-force is exerted against each of support face 102 of gasket rest 100 and flange 55 face $F_F$ to form a moisture ingress resistant seal between backshell 65 and frontshell 15. The moisture ingress resistant seal preferably meets the requirements of Electronic Industries Alliance's EIA-364-03B-1999 (R2006) Altitude Immersion Test Procedure For Electrical Connectors.

Figure 13:
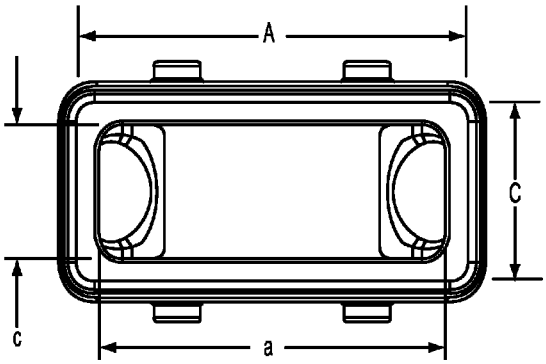
FIG. 13 is a front plan view showing exemplary gasket dimensions used to calculate clamping force.

In a preferred embodiment, the seating force is determined using the surface contact area for gasket 105 and expected pressure differential a connector will experience. For example, the American Society of Mechanical Engineers Pressure Vessel Code, Section VIII, Division 1 may be used, and equations may be modified to accommodate specific gasket geometry, such as the geometry of gasket 105. For a gasket geometry illustrated in FIGS. 10 and 13, a formula for determining seating force is preferably Force=((A+a)/2)*((C+c)/2)*P+2*b*m*P*(A+a+C+c). With reference to FIG. 13 "A" is the major exterior length of gasket 105, "a" is the major interior length of gasket 105, "C" is the minor exterior length of gasket 105, "c" is the minor interior length of gasket 105. "P" is the design pressure in pounds per square inch, "b" is the effective gasket or joint contact surface seating width in inches, preferably from Table Two in the *Gasket Handbook*, published by the Lamons Gasket Company, and "m" is the gasket factor, preferably from Table One in the *Gasket Handbook*, published by the Lamons Gasket Company. Preferably, gasket 105 is made using a self-seating material, in other words, a material with a hardness of less than 75 Shore A, so the initial load required to seat gasket 105 may be ignored.

Solving the above equation for a preferred embodiment includes calculating the "b" value as N/2 where N is the gasket 105 thickness. In a preferred embodiment, gasket 105 has a width of 0.100 inch, thus "b"=0.050 inch. Preferred dimensions, in inches, are A=1.040, a=0.840, C=0.505, and c=0.305. For a preferred fluorosilicone meeting the requirements of U.S. military specification MIL-R-25988/1A (Jul. 10, 1975) "m" is 0.50. "P" is calculated using the expected altitude difference the sealed connector assembly is expected to encounter. For example, using standard conditions for temperature and pressure for an altitude difference ranging from seal level (14.696 psi) to 25,000 feet (5.454 psi), the pressure differential is approximately 18.817 inches of mercury, or approximately 9.242 psi. Including a margin of safety, a value of 9.5 psi is preferably used for "P." Solving the above equation thus results in a seating force of 4.9 pounds. Again, rounding up to include an additional margin of safety, a seating force of 5 pounds is preferably applied to gasket 105.

In a preferred embodiment the set screws 110 are located on the backshell 65 so they can be tightened to create the appropriate clamping force as the tapered tips 120 engage the back edge 56 of flange 55. Other suitable clamping forces may be used.

Figure 15:
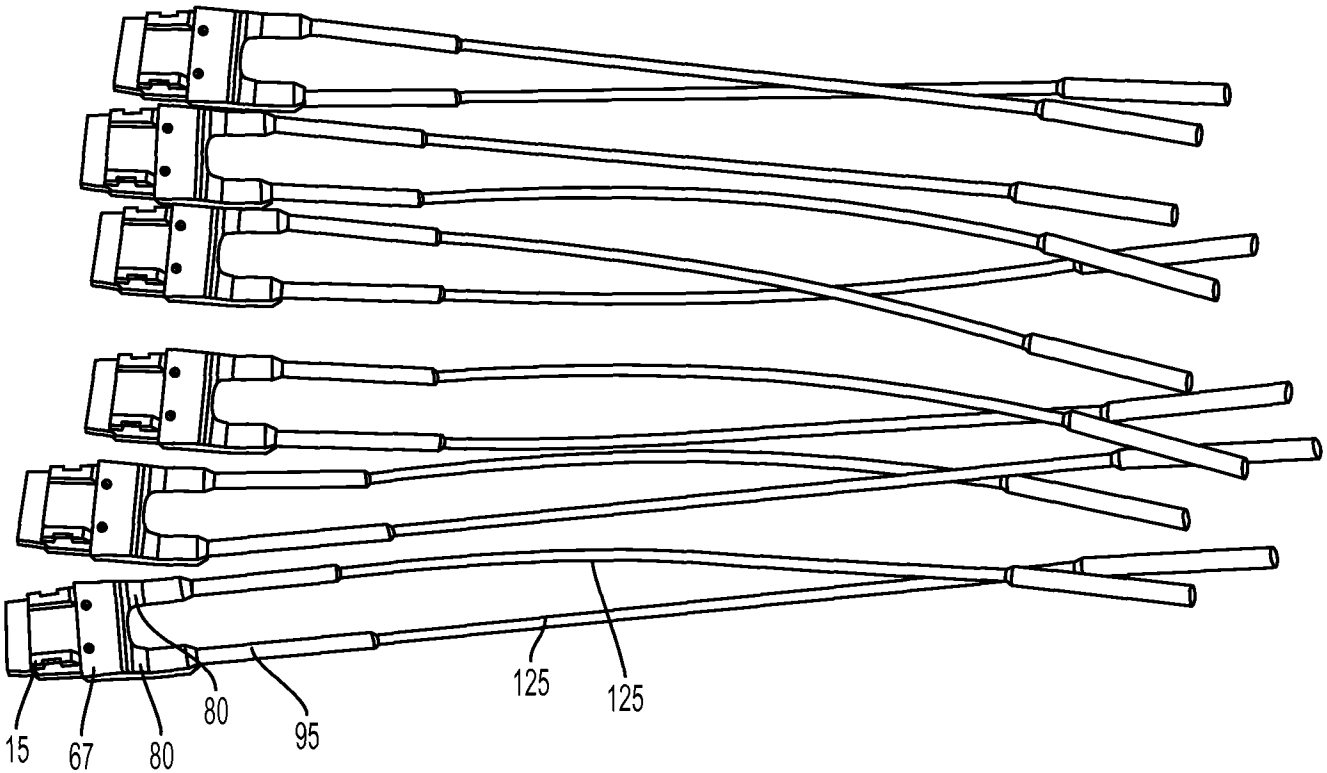
FIG. 15 is a top perspective view of assembled connectors.

FIG. 15 illustrates an adhesive-lined heat-shrink tube 95 placed over each electrical conductor 125 and its associated strain relief 80. Adhesive-lined heat-shrink tube 95 is preferably ATUM, manufactured by Tyco Electronics Corporation of Menlo Park, Calif., United States, which is semi-flexible. However, other suitable heat-shrink tubing materials may be used and they may range from flexible to rigid.

During assembly, heat is applied to each adhesive-lined heat-shrink tube 95 to cause the adhesive-lined heat-shrink tube 95 to shrink and mechanically grip electrical conductor 125 and associated strain relief 80. Shrinking secures an adhesive-lined heat-shrink tube 95 to each strain relief 80 and forms a moisture ingress resistant seal. Preferably, each adhesive-lined heat-shrink tube 95 undergoes a greater shrinkage proximate where grooves 85 are formed in strain reliefs 80 (FIG. 5) compared to sections of strain reliefs 80 without grooves 85, for example, the section of strain relief 80 illustrated between grooves 85 in FIG. 5. Such differential shrinkage may assist creating a mechanical grip between each adhesive-lined heat-shrink tube 95 and its associated strain relief 80 that resists separation of each adhesive-lined heat-shrink tube 95 from its associated strain relief 80.

The applied heat also preferably causes the adhesive lining each adhesive-lined heat-shrink tube 95 to soften or flow into grooves 85 and thus when the adhesive re-solidifies contribute to the mechanical grip and the moisture ingress resistant seal. Preferably, softened or flowing adhesive fills or substantially fills each groove 85 to form an O-ring like portion that contributes to the moisture ingress resistant seal when the adhesive re-solidifies, for example, upon cooling to room temperature. Including multiple grooves 85 preferably forms multiple O-ring like portions each of which provides redundant moisture ingress resistant seal capabilities should one of the O-ring like portions fail to resist moisture ingress. In a preferred embodiment, five grooves 85 are included on each strain relief 80, while fewer or greater numbers of grooves may be used in other embodiments.

It will be obvious to those having skill in the art that many changes may be made to the details of the above-described embodiments without departing from the underlying principles of the invention. The scope of the present invention should, therefore, be determined only by the following claims.

The invention claimed is:

1. A backshell for a connector comprising:

a backshell body including an opening, the opening shaped to substantially match a flange protruding from a frontshell where the flange forms a gasket seat, wherein the opening is sized to overlap the flange;

a gasket rest attached to the opening, the gasket rest including a support face;

a pliable gasket shaped to substantially match the opening, wherein the pliable gasket is located on the support face; and a mechanical fastener attached to the backshell body, the mechanical fastener including a sloped surface and the mechanical fastener located on the backshell body at a position configured for movement of the mechanical fastener to engage the sloped surface with a portion of the flange facing away from the backshell body when the backshell is connected to the frontshell.

2. A backshell according to claim 1, wherein the mechanical fastener comprises:

a threaded boss formed in the backshell body, the threaded boss located between the gasket rest and an edge of the opening; and a set screw threadably engaged in the threaded boss, the set screw having a tool engaging end and a distal end, wherein the sloped surface is located at the distal end.

3. A backshell according to claim 2, wherein threads on the set screw are mismatched with respect to threads in the threaded boss.

4. A backshell according to claim 1, further comprising a seating groove formed in the support face.

5. A backshell according to claim 1, wherein the backshell is rigid and is made from a solid piece of material, the backshell further including:

a strain relief extending away from the opening, wherein the strain relief includes an oval cross section.

6. An electrical connector having a backshell according to claim 5, further comprising:

a plurality of circular grooves spaced along the strain relief;

an electrical conductor passing through the strain relief; and an adhesive-lined heat-shrink tube adhered to the electrical conductor and the strain relief to form a moisture ingress resistant seal;

wherein the heat-shrink tube is adhered to the electrical conductor by a combination of mechanical gripping and the adhesive;

wherein the heat-shrink tube is adhered to the strain relief by a combination of mechanical gripping and the adhesive; and wherein the adhesive substantially fills each circular groove.

7. An electrical connector according to claim 6, wherein each circular groove includes a radius.

8. A connector comprising:

a frontshell including a closed front connection side and an open side;

a gasket seat attached to the open side, the gasket seat including a perimeter;

a backshell including an opening that overlaps the gasket seat, wherein an interior dimension of the opening is substantially the same as the perimeter of the gasket seat;

a gasket rest attached to an interior of the backshell opening;

a mechanical fastener engaging the backshell and engaging a portion of the gasket seat of the frontshell that faces away from the backshell to hold the backshell in a position overlapping the gasket seat;

a pliable gasket having a perimeter that substantially matches the interior of the backshell opening, wherein the pliable gasket is interposed between the gasket seat and the gasket rest, and the pliable gasket is compressed by the mechanical fastener holding the backshell in a position overlapping the gasket seat; and a moisture ingress resistant seal between the backshell and the protrusion formed by the deformed pliable gasket.

9. A connector according to claim 8, wherein the mechanical fastener further comprises a sloped surface that engages the portion of the gasket seat of the frontshell that faces away from the backshell, and the sloped surface is configured to draw the backshell and the front shell towards each other as the mechanical fastener is moved into engagement with the portion of the gasket seat of the frontshell that faces away from the backshell.

10. A connector according to claim 9, wherein the mechanical fastener comprises:

a threaded boss formed in the backshell, the threaded boss located between the gasket rest and an edge of the opening; and a set screw threadably engaged in the threaded boss, the set screw having a tool engaging end and a distal end, wherein the sloped surface is located at the distal end.

11. A connector according to claim 10, wherein threads on the set screw are mismatched with respect to threads in the threaded boss.

12. A connector according to claim 8 wherein the pliable gasket is deformed by being compressed to approximately 50% of its original thickness.

13. A connector according to claim 8, wherein the gasket exerts a force of approximately 5 pound-force on the gasket seat and on the gasket rest.

14. A connector according to claim 8, further comprising a seating groove formed in the gasket rest.

15. A connector according to claim 8, wherein the backshell is rigid and is made from a solid piece of material, the backshell further including:

a strain relief extending away from the opening, wherein the strain relief includes an oval cross section.

16. A connector according to claim 15, further comprising:

a plurality of circular grooves spaced along the strain relief;

an electrical conductor passing through the strain relief; and an adhesive-lined heat-shrink tube adhered to the electrical conductor and the strain relief to form a moisture ingress resistant seal;

wherein the heat-shrink tube is adhered to the electrical conductor by a combination of mechanical gripping and the adhesive;

wherein the heat-shrink tube is adhered to the strain relief by a combination of mechanical gripping and the adhesive; and wherein the adhesive substantially fills each circular groove.

17. A connector according to claim 16, wherein each circular groove includes a radius.

18. A method of forming a moisture ingress resistant connector comprising:

providing a frontshell including a closed front connection side and an open side, the open side including a gasket seat attached thereto;

providing a rigid backshell having an integral strain relief, the backshell including an opening and a gasket rest within the opening;

placing a gasket having a thickness and a perimeter that substantially matches the backshell opening into the backshell opening and against the gasket rest;

placing the backshell opening over the gasket seat and pressing the gasket between the gasket rest and the gasket seat;

securing a mechanical fastener to the backshell and to a portion of the gasket seat facing away from the backshell to compress the gasket and form a moisture ingress resistant seal between the backshell and the frontshell.

19. A method of forming a moisture ingress resistant connector according to claim 18, further comprising:

placing an electrical conductor through the strain relief and electrically connecting the electrical conductor to the closed front connection side of the frontshell;

placing an adhesive-lined heat-shrink tube over the electrical conductor and the strain relief; and heating the heat-shrink tube to cause the heat-shrink tube to mechanically grip the electrical conductor and the strain relief and to cause the adhesive to melt and adhere to the electrical conductor and the strain relief thereby forming a second moisture ingress resistant seal.

20. A method of forming a moisture ingress resistant connector according to claim 19, wherein the strain relief further includes a plurality of circular grooves on an exterior surface, the method further comprising:

melting the adhesive lining the heat-shrink tube to cause the adhesive to flow into and substantially fill each circular groove.

21. A backshell for a connector comprising:

a backshell body including an opening, wherein the backshell is rigid and is made from a solid piece of material;

a strain relief extending away from the opening, wherein the strain relief includes an oval cross section;

a plurality of circular grooves spaced along the strain relief;

an electrical conductor passing through the strain relief; and an adhesive-lined heat-shrink tube adhered to the electrical conductor and the strain relief to form a moisture ingress resistant seal, wherein the adhesive substantially fills each circular groove.

22. A backshell for a connector according to claim 21, wherein each circular groove includes a radius.

* * * * *